United States Patent [19]

Meinhart

[11] 4,055,005

[45] Oct. 25, 1977

[54] COVER FOR BICYCLING SHOE TO PROVIDE A WALKING SURFACE

[76] Inventor: Robert H. Meinhart, 354 Wilbur Road, Thousand Oaks, Calif. 91360

[21] Appl. No.: 736,834

[22] Filed: Oct. 29, 1976

[51] Int. Cl.[2] ..... A43B 5/00

[52] U.S. Cl. ..... 36/135; 2/DIG. 6

[58] Field of Search ..... 36/7.3, 132, 135, 1 2/DIG. 6

[56] References Cited

U.S. PATENT DOCUMENTS

| | | | |
|---|---|---|---|
| 3,104,479 | 9/1963 | D'Amico | 2/DIG. 6 |
| 3,858,336 | 1/1975 | Brown | 36/135 |
| 3,987,510 | 10/1976 | Sbicca | 36/135 |

*Primary Examiner*—Patrick D. Lawson

*Attorney, Agent, or Firm*—Fulwider, Patton, Rieber, Lee & Utecht

[57] ABSTRACT

A protective cover including a sole that provides a walking surface fits over a bicycling shoe that has a cleat attached to its underside. The cover includes a toe cup and a U-shaped wall at its opposite ends to engage the ends of the shoe. The upper surface of the sole defines a rectangular recess that receives the cleat. The sole, toe cup and wall are integrally formed from a single piece of molded material that can be stretched to snugly, but releasably, hold the shoe.

3 Claims, 3 Drawing Figures

COVER FOR BICYCLING SHOE TO PROVIDE A WALKING SURFACE

BACKGROUND OF THE INVENTION

The present invention relates to protective covers for shoes, and more particularly to a protective cover for attachment to a cleated bicycling shoe.

It is well known among devotees of the sport of cycling that a cyclist's performance can be improved by the use of specially constructed bicycling shoes which have cleats attached to their bottom surfaces. The corresponding pedal structure of the bicycle typically engages the cleat to prevent undesired side-to-side or front-to-back motion of the shoe relative to the pedal and often includes a toe clip that sweeps over the top of the shoe. This arrangement allows the cyclist to pedal more vigorously without fear that his feet will become disengaged from the pedals and that time will be lost in regaining the proper position. The interlock between the cleat and the pedal permits him to thrust the pedal forward with great force along the top of the stroke and backward with greater force along the bottom of the stroke. The toe clip enables him to pull the pedal upwardly on the back half of the stroke as the opposite pedal is pushed downwardly. The improvement in speed and stamina that can be obtained in this way is substantial.

There are, however, disadvantages associated with cleated bicycling shoes that have prevented them from gaining wider acceptance. The cleats, which generally extend under the ball of the foot, make it difficult to walk in the shoes after the bicycle has been dismounted. When walking is unavoidable, the cleats may be worn or damaged and can easily deface floors and other surfaces. In addition, the cleats tend to catch or slip on hard surfaces and are therefore dangerous.

While the disadvantages of cleated bicycling shoes are a significant inconvenience to racers, they are an even greater problem to cyclists traveling long distances who often wish to leave their bicycles at various points along the way. A particularly difficult problem is presented if the bicycle should break down, since walking long distances on the cleats is very difficult, if not impossible. Since cyclists wish to pack as little gear as possible, they generally object to the bulk and weight of an extra pair of shoes to be carried just for walking.

The principal objective of the present invention is to provide a simple, inexpensive, lightweight and easily carried detachable cover for a cleated bicycling shoe that adapts the shoes for safe and comfortable walking.

SUMMARY OF THE INVENTION

The present invention is a protective cover to be worn over a bicycling shoe, having a rectangular recess extending from the ball of the foot rearwardly into the arch area in which a cleat on the bottom of the shoe is received. The cover adapts the shoe for safe and comfortable walking and can be quickly and easily attached and removed. It is of a simple construction that is light in weight so that it can be readily carried by a cyclist.

The cover includes a sole to which a toe cup is attached at its toe end and a U-shaped wall is attached at its heel end. The entire cover is formed from a single piece of pliable, flexible, molded material that can be stretched to snugly and securely engage shoes that differ significantly in size and configuration. Straps can be attached to the U-shaped wall on opposite sides of the sole and fastened across the instep of the shoe to more securely retain the cover.

Other features and advantages of the present invention will become apparent from the following detailed description taken in conjunction with the accompanying drawings, which illustrate, by way of example, the principles of the invention.

DESCRIPTION OF THE PREFERRED EMBODIMENT

The present invention resides in a protective cover used to adapt bicycling shoes for walking. The cover fits over the bottom of the shoe, which carries a metal cleat and is not properly contoured for walking, to provide a suitable walking surface.

Figure 1:
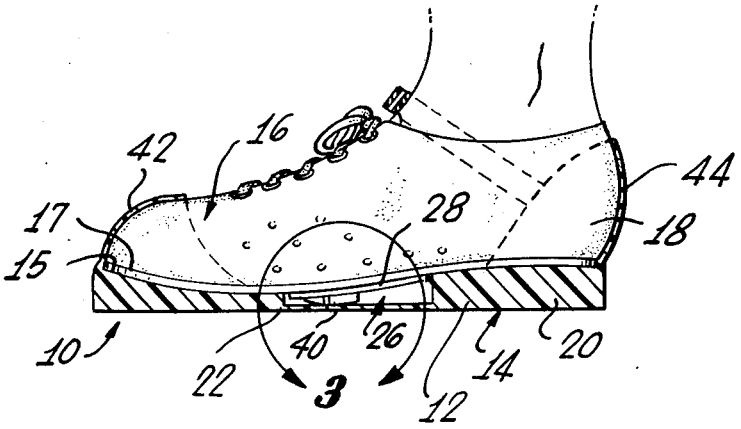
FIG. 1 is a cross-sectional, side view of a protective cover that embodies the present invention shown in engagement with a cleated bicycling shoe.
Figure 2:
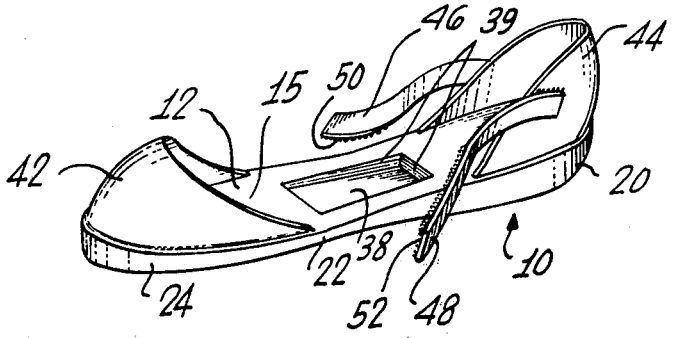
FIG. 2 is a three-dimensional perspective view of the cover.
Figure 3:
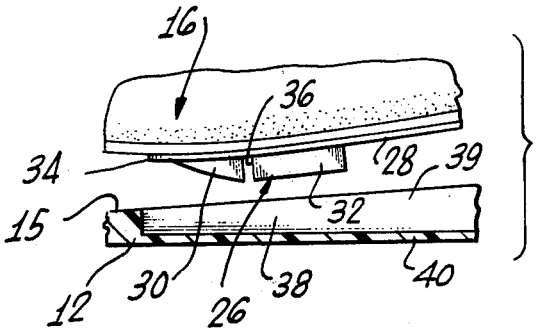
FIG. 3 is an enlarged fragmentary portion of the cross-section of FIG. 1, showing, in greater detail, the cleat of the bicycling shoe and a recess in the sole of the cover in which it is received.

As illustrated in the drawings, an exemplary protective cover that embodies the invention includes a sole 12 which, when viewed from the top or bottom, has the outline of the sole of conventional footwear. It has a flat bottom surface 14 (FIG. 1) and a contoured top surface 15 that corresponds to the curvature of the underside of a bicycling shoe 16. The sole 17 of the bicycling shoe is of uniform thickness with no provision for raising the heel 18 in the manner of a conventional walking shoe, but the protective cover is substantially thicker in cross-section at the heel portion 20 than it is at the center portion 22 corresponding to the ball of the foot to raise the heel to its normal position. The sole is also of increased thickness in the toe portion 24 where the bicycling shoe turns upwardly.

The shoe 16 includes a cleat 26 of a conventional design that interlocks with the pedal structure of a bicycle (not shown). The cleat is formed by a thin metal plate 28 which begins at the center of the ball of the foot and extends rearwardly under the arch of the foot conforming to the curvature of the underside 17 of the shoe. Two metal blocks 30 and 32 are attached crosswise to the bottom of the plate. The first block 30 tapers toward the toe of the shoe so that it is triangular in cross-section when viewed from the side, and the second block 32, which is rectangular in cross-section when viewed from the side, is positioned behind the first. A narrow channel 36 extends across the shoe between the first and second blocks. The cleat construction is described here merely by way of example, and the protective cover 10 of the invention is in no way limited to use with one particular type of cleat.

To receive the cleat 26, the sole 12 of the cover 10 defines a recess 38, having straight vertical sides 39, that is of rectangular outline when viewed from the top. The recess extends rearwardly from the center of the ball of the foot and encompasses most of the area of the arch of the foot, but does not extend into the heel area. The depth of the recess is sufficient to receive the full vertical dimension of the first and second cleat blocks 30 and 32, and the area 22 of the sole at the ball of the foot, where the sole is thinest, is thick enough to leave a thin, flat floor 40 of uniform thickness beneath the recess. Although it is preferable that the recess encompass at least a part of that portion of the sole that corresponds to the ball and arch of the foot, its precise position, size, and shape may be varied to accommodate a particular cleat.

The cover 10 includes a toe binding means for holding the toe of the shoe 16 in contact with the toe portion 24 of the sole 12. This binding takes the form of a cup 42 attached to the toe end of the sole and opening toward the heel for receiving the toe of the shoe and engaging its front and top surfaces. A heel binding takes the form of a U-shaped, upstanding wall 44 that extends from heel 20 of the sole 12 and opens toward the toe 24 to receive the heel 18 of the shoe 16. The wall, like the toe cup 42, is of substantially lesser thickness than the outside edge of the sole measured at any location. As an aid in retaining the shoe within the cover 10, two straps 46 and 48 extend from the wall on either side of the sole. One strap 46 is provided with miniature hooks that randomly engage small loops 52 on the opposing face of the other strap 48 to form a fastener of the Velcro type for releasably connecting the straps across the instep of the shoe 16.

The entire cover 10 is integrally formed by a single piece of pliable, flexible, molded material which may be natural or synthetic rubber. It can be stretched sufficiently to be pulled over shoes that differ slightly in size and shape for a tight, snug fit. The shoe 16 can easily be released by simply pulling downwardly on the wall 44 or heel 20 of the cover.

It will be apparent from the foregoing that the protective cover of the invention is not only of a simple construction that can be readily manufactured at low cost, but it is light in weight and can be bent or folded as desired so that it is readily carried by a cyclist. It can be quickly and easily slipped on or off and is therefore an article of great usefulness and convenience to cyclists.

While a particular form of the invention has been illustrated and described, it will be apparent that various modifications can be made without departing from the spirit and scope of the invention.

I claim:

1. For use with a bicycling shoe that has a cleat attached to its bottom surface to engage the pedal structure of a bicycle, a protective cover for adapting the bicycling shoe for walking comprising:

a sole that provides a walking surface;

a toe cup attached to the toe end of said sole for receiving the toe of the bicycling shoe; and an upstanding U-shaped wall extending from the heel end of said sole and opening toward the toe end of said sole for receiving the heel of the bicycling shoe;

said sole being of substantially greater thickness than said cup and said wall and having a substantially greater thickness at the heel than under the ball of the foot;

the upper surface of said sole defining a generally rectangular recess that extends from the portion of said sole corresponding to the ball of said foot into the arch area to receive the cleat of the bicycling shoe;

said sole, cup and wall being integrally formed from a single piece of pliable, flexible, molded, natural or synthetic rubber that can be stretched to snugly engage the bicycle shoe.

2. The cover of claim 1, further comprising first and second straps attached to said heel binding means on opposite sides of said sole, and fastening means for connecting said straps across the instep of the bicycling shoe.

3. The cover of claim 1, wherein said fastening means comprises a multiplicity of randomly interlocking hooks for connecting said strap across the instep of the bicycling shoe.

* * * * *

UNITED STATES PATENT AND TRADEMARK OFFICE

CERTIFICATE OF CORRECTION

PATENT NO. : 4,055,005

DATED : Oct. 25, 1977

INVENTOR(S) : Robert H. Meinhart

It is certified that error appears in the above-identified patent and that said Letters Patent are hereby corrected as shown below:

Column 4, line 35 (claim 3); after "claim" change "1" to --2--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*